United States Patent [19]

Varden

[11] 4,431,174

[45] Feb. 14, 1984

[54] VICE

[76] Inventor: Arnold Varden, 10 Sarjeant Dr., Box 954, Barrie, Ontario, Canada, L4M 4T6

[21] Appl. No.: 329,851

[22] Filed: Dec. 11, 1981

[51] Int. Cl.[3] ..... B25B 1/02

[52] U.S. Cl. ..... 269/211

[58] Field of Search ..... 269/208, 207, 211, 212, 269/214, 285, 329, 247, 250; 308/3.5, 3 A

[56] References Cited

U.S. PATENT DOCUMENTS

| | | | |
|---|---|---|---|
| 359,833 | 3/1887 | Basinger | 269/211 |
| 711,948 | 10/1902 | Dodge . | |
| 825,171 | 7/1906 | Anderson | 269/207 |
| 1,223,928 | 4/1917 | Benson | 269/211 |
| 1,430,226 | 9/1922 | Goodreau | 269/208 |
| 1,638,848 | 8/1927 | Hargrave | 269/212 |
| 2,360,091 | 10/1944 | Wing | 269/208 |
| 2,511,843 | 6/1950 | Graether . | |
| 2,514,615 | 7/1950 | Aber . | |
| 2,724,295 | 11/1955 | Persson | 269/212 |
| 3,088,729 | 5/1963 | Marcus . | |
| 3,515,444 | 6/1970 | Grabner | 308/3.5 |
| 3,578,308 | 5/1971 | Jesionowski . | |
| 3,630,512 | 12/1971 | Paret | 269/207 |
| 3,767,183 | 10/1973 | Van Gelder . | |
| 4,221,369 | 9/1980 | Takasugi | 269/250 |

FOREIGN PATENT DOCUMENTS

| | | | |
|---|---|---|---|
| 1040467 | 10/1958 | Fed. Rep. of Germany | 269/208 |

OTHER PUBLICATIONS

Brochure: "Gerardi Precision Modular Vises", 21017 Samarate, S. Gervaso.

*Primary Examiner*—Robert C. Watson

[57] ABSTRACT

A quick-release vice or work holder capable of rapid opening or closing and clamping, comprises a bed, a fixed jaw affixed to the bed and a movable jaw means. The bed has an inverted T-shaped central longitudinally-extending slot with at least one substantially vertical face having a plurality of recesses therein. The movable jaw has a guide means and a locking means. The guide means is slidably mounted on the bed for travel therealong. The locking means includes at least one pin adapted to move transversely of the slot to engage one of the recesses.

7 Claims, 8 Drawing Figures

VICE

This invention relates to vices and work holders and in particular to vices having releasable jaw means which are capable of rapid adjustment of the spacing between the jaws.

Vices which are capable of rapid adjustment are convenient for use in holding articles during machining operations and the like. A fine pitch thread may be used for the typical clamping screw but would be unsuitable for quick jaw-spread adjustment. It is known to provide quick release catches which, upon operation, disconnect the screw thread in some way, allowing one jaw to slide freely to a new position where it may be locked. The screw can then tighten the jaws as usual.

U.S. Pat. No. 2,511,843 discloses a vice comprising a longitudinally T-shaped grooved base having a fixed jaw and a movable jaw slidably mounted for travel along two guideways. The movable jaw is provided with a central opening through which an adjusting screw shaft support extends downwardly into the groove. The shaft support has pawl teeth selectively engaging ratchet teeth on the horizontal undersides of the guideways. The screw shaft support is tilted forward to disengage the pawl teeth from the ratchet teeth and permit free sliding movement, so that the movable jaw may be readily moved forward or backward to accommodate the workpiece.

U.S. Pat. No. 3,088,729 discloses a vice in which a jaw slidably accommodated on a track support is provided with a cylindrical locking pawl plunger, which is itself slidably housed in a vertical bore extending through the jaw. The locking pawl plunger is provided at its lower end with a plurality of downwardly extending pawl teeth adapted to mate with corresponding pawl tooth recesses in the horizontal upper surface of the track support so that the jaw is fixed in position on the track support. A sliding cam actuator is provided for lowering the plunger so that the teeth engage the recesses, and for raising the plunger so that the teeth are disengaged and the jaw is free to be slid back and forth along the track support.

Thus, in U.S. Pat. Nos. 2,511,843 and 3,088,729, a movable jaw is "locked" when pawl teeth engage recesses on horizontal surfaces of, respectively, guideways and a track support. These recesses are located in the upper portion of the vice where the material is less massive than at its base, and accordingly less able to withstand large clamping forces.

The present invention is concerned with a quick-release vice capable of rapid adjustment of the spacing between a movable and a fixed jaw. Further, in the preferred embodiment the locking of the movable jaw occurs at the base of the vice, which is therefore capable of large clamping forces.

Other advantages of the invention are the accuracy of guiding and the positiveness of the lock of the movable jaw on the bed of the vice, and the ease of operation of the vice.

According to the invention, the quick-release vice or work holder comprises a bed, a fixed jaw affixed to the bed, and a movable jaw means. The bed has a longitudinally extending slot. The slot has at least one substantially vertical face having a plurality of recesses therein. The movable jaw means has a guide means and a locking means. The guide means is slidably mounted on the bed for travel therealong. The locking means includes engaging means, preferably at least one pin, adapted to move transversely of the slot to engage one of the recesses.

The invention will now be more fully described with reference to the accompanying drawings, illustrating a preferred embodiment in which.

Figure 1:
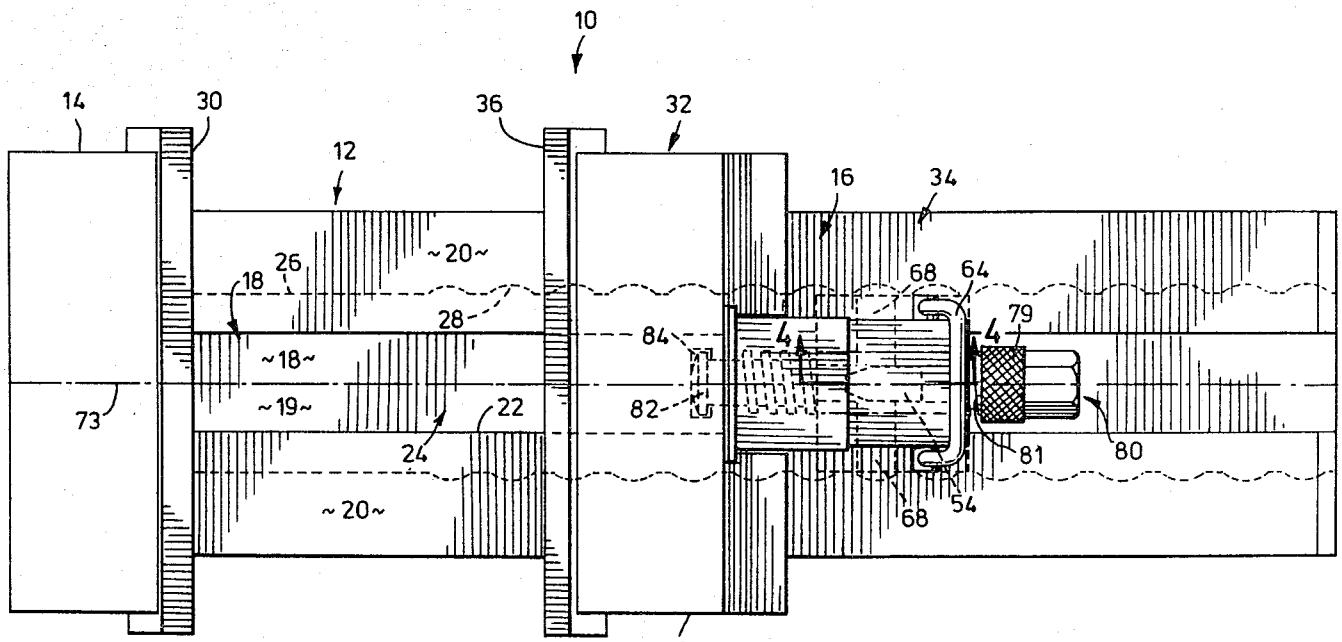
FIG. 1 is a top plan view.

The vice, shown in plan view in FIG. 1 and indicated generally at 10, comprises a bed 12 to which is affixed a fixed jaw 14, and a movable jaw means 16.

Figure 3:
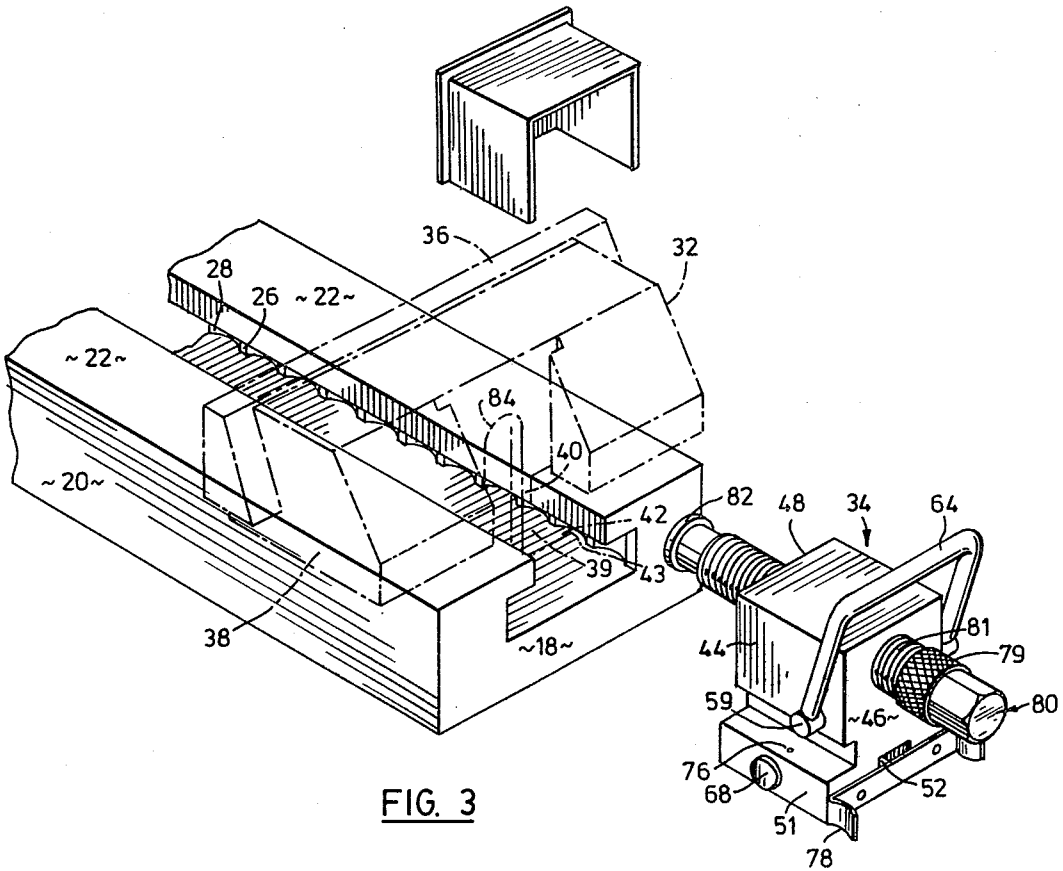
FIG. 3 is a fragmentary perspective view of the vice as shown in FIG. 1.

The bed 12 comprises a bottom portion 18, upwardly extending side portions 20 and inwardly extending guide bars 22 (FIG. 3). Bottom portion 18, side portions 20 and guide bars 22 together define an inverted T-shaped central longitudinal slot 24 which extends substantially along the length of the bed. The slot is in part defined by upper surface 19 of bottom portion 18 and by two substantially vertical hidden faces 26 of side portions 20. Each of faces 26 has a plurality of part-curved recesses 28 therein, as described below. The fixed jaw 14 is fixed to bed 12 and is provided with a hardened jaw plate 30 removably secured.

Figure 2:
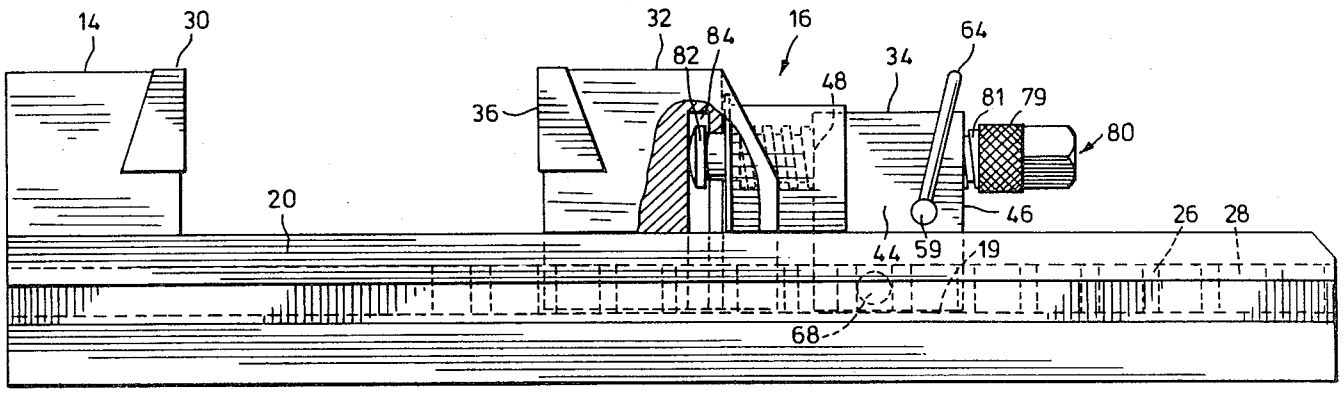
FIG. 2 is a side elevational view of the vice as shown in FIG. 1.

The movable jaw means 16 comprises a guide means 32 and a locking means 34 (FIGS. 1, 2 and 3).

A hardened jaw plate 36 is removably secured to guide means 32. The guide means 32 comprises an upper portion 38, which overhangs the bed 12 of the vice. Guide block 32 further comprises an inverted T-shaped portion 39 consisting of a neck 40 (FIG. 3) extending downwardly from the upper portion 38 between the guide bars 22 and two outwardly extending portions 42, the vertical lateral surfaces 43 of which engage hidden faces 26 of side portions 20 so as to slide therealong. The lower surface of portion 39 engages upper surface 19 of bottom portion 18 so as to slide therealong. (Alternately, the lower surface of the upper portion 38 may engage the upper surfaces of guide bars 22 so as to slide therealong.)

Figure 4:
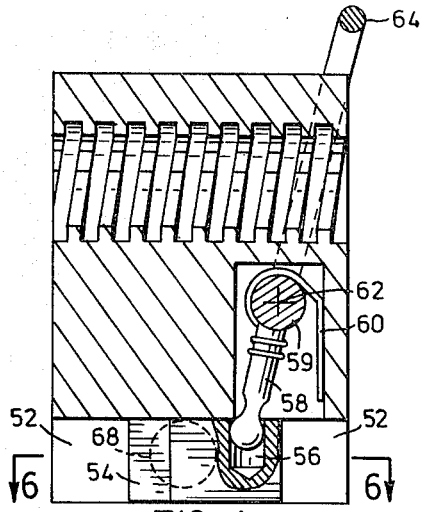
FIG. 4 is a sectional view on the line 4—4 of FIG. 1 showing the locking means in its locked mode.
Figure 5:
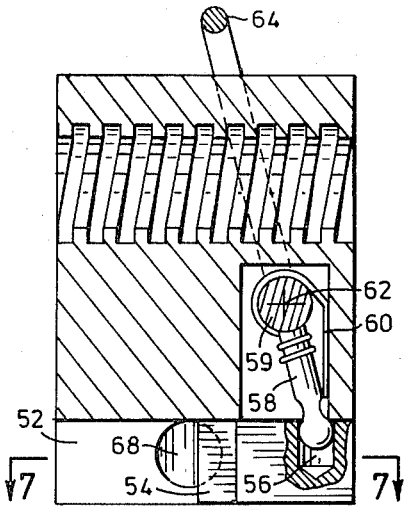
FIG. 5 is a similar view to that of FIG. 4 showing the locking means in its released mode.

The locking means 34 comprises an inverted T-shaped block with side walls 44 and front and rear walls 46 and 48 respectively, extending downward between the guide bars 22, and having outwardly extending portions 50, the lower surfaces of which engage the upper surface 19 of bottom portion 18 so as to slide therealong. Similarly the vertical lateral surfaces 51 of portions 50 engage hidden faces 26 of side portions 20 so as to slide therealong. As shown in FIG. 3, a channel 52 extends horizontally from front to rear of the lower end of locking means 34, midway between outwardly extending portions 50. An actuator bolt 54 is slidably disposed in channel 52. The actuator bolt 54 is supported by and engages upper surface 19 of bottom portion 18 of the bed. As shown in FIGS. 4 and 5, the upper surface of actuator bolt 54 is provided with a recess 56 adapted to accommodate the lower end of a pivoted bolt lever 58. Bolt lever 58 is affixed to a substantially horizontal pivot rod 59 journaled in walls 44 for rotation about axis 62. The pivot rod 59 is also retained within a spring 60. The spring 60 rotates the pivot rod and thereby urges the bolt lever and the actuator bolt to the position shown in FIGS. 4 and 6. The bolt lever 58 may be moved to the position shown in FIG. 5 by manual rotation of the pivot rod 59 by moving a release lever 64. The release lever 64 is a U-shaped member and may be retained within two holes drilled near the ends of pivot rod 59. Thus movement of the release lever 64 against the pressure of spring 60 from the position shown in FIG. 4 to the position shown in FIG. 5 moves the actuator bolt 54 as illustrated from a locking position to an unlocking position (significance described below). Conversely, when the bolt lever 58 is returned to the position shown in FIG. 4 by hand or by spring 60, actuator bolt 54 is moved from the unlocking position to the locking position.

Figure 6:
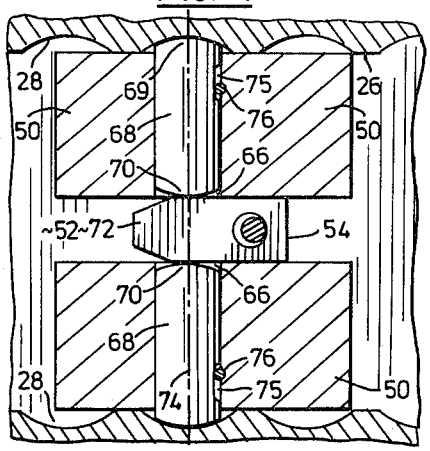
FIG. 6 is a fragmentary sectional view taken in the direction of lines 6—6 of FIG. 4.
Figure 7:
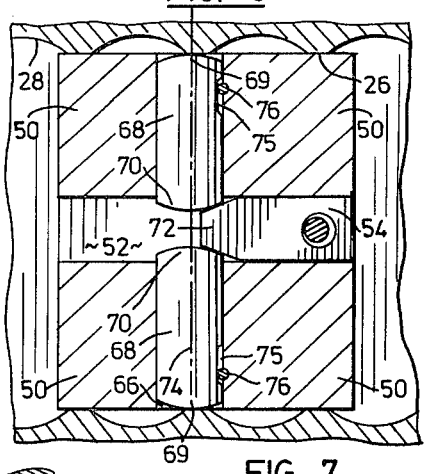
FIG. 7 is a fragmentary sectional view taken in the direction of lines 7—7 of FIG. 5.

Locking means 34 shown in fragmentary view in FIGS. 6 and 7 has two horizontal opposed passages 66 transverse to and registering with channel 52. Passages 66 are adapted to register with the recesses 28 in faces 26 of bed 12. A pin 68 is slidably housed within each passage 66. Each pin 68 is of slightly greater length than the corresponding passage 66. The end 69 of each pin 68 distal to channel 52 is partly curved so that it may mate with recesses 28. The end 70 of each pin 68 proximal to channel 52 is of part-circular section as shown in FIGS. 6 and 7, while the end 72 of actuator bolt 54 adjacent pins 68 is wedge-shaped. The wedge-shaped end 72 co-operates with ends 70 of pins 68 such that when the release lever 64 is in its position so as to have advanced actuator bolt 54 to the locking position illustrated in FIGS. 4 and 6, pins 68 are then urged into opposing recesses 28. The locking means 34 thus remains fixed to bed 12 so long as release lever 64 is in this position.

Figure 8:
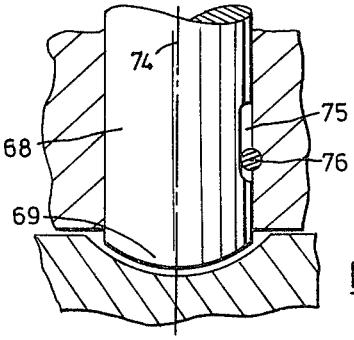
FIG. 8 is an enlarged view of one of the recesses of FIG. 6.

In the illustrated embodiment each recess 28 has part-curved surface. Each recess 28 (FIG. 8) is preferably of part-cylindrical or part-spherical shape.

The part-curved shape of recess 28 is such that when actuator bolt 54 is in its unlocking position so that pins 68 are no longer urged into recesses 28, pins 68 will slide up or ride up the sides of recesses 28, or cam-out of recesses 28 (FIG. 7), if a moderate force is exerted upon the locking means 34 in a direction along the bed 12 of vice 10. The invention is not limited to the specific part-curved shape illustrated.

Recesses 28 may also be of other than the part-curved shape but then means must be provided for the retraction of pins 68 when actuator bolt 54 is in its unlocking position.

When ends 69 of pins 68 are of part-cylindrical shape as shown in the preferred embodiment, stabilizing means is provided to prevent accidental rotation of pins 68 about their axis 74—74 so that ends 69 are then unable to mate with recesses 28. Such means comprises a recess 75 in the side of each pin 68 and a vertically extending pin 76 retained within a bore in portion 50 and passing through recess 75. Thus each pin 76 prevents each pin 68 from rotating about axis 74—74 while recess 75 is of sufficient lateral extent to permit free travel of each pin 68 into and out of recess 28 (FIGS. 6 and 7).

Movable jaw means 16 further comprises four wipers 78, one at each of the two leading and trailing corners. The wipers which are preferably of spring steel are so positioned as to sweep swarf out of recesses 28 when movable jaw means 16 is moved in either direction along bed 12.

Guide means 32 is advanced or retracted by rotation of nut 79 of a conventional vice screw 80 having threads 81 using a wrench or handle adapted to engage nut 79. Vice screw 80 is threaded through locking means 34, and has a cap 82 loosely disposed in a slot 84 in guide means 32 (FIGS. 1, 2 and 3). Guide means 32 is provided with a T-shaped slot 86 adjacent locking means 34 for receiving an inverted substantially U-shaped shroud 88, as shown in FIGS. 1, 2 and 3. The shroud 88 shields the portion of vice screw 80 between guide means 32 and locking means 34 from accumulation of swarf in threads 81.

To operate vice 10, release lever 64 is moved to the position shown in FIG. 5 so as to move actuator bolt 54 to its unlocking position. Movable jaw means 16 may now be moved forward or backward until the workpiece fits approximately between the jaw plates 30 and 36. The release lever 64 is then returned to the position shown in FIG. 4 to move actuator bolt 54 to its locking position so that pins 68 are then urged into the nearest opposite recesses 28. Nut 79 of vice screw 80 is then rotated to advance the guide means 32 to clamp the workpiece tightly between jaw plates 30 and 36.

Guide means 32 and locking means 34 are at all times engaged by the upper surface 19 of bottom portion 18 and by hidden faces 26 of side portions 20, which ensures accuracy of guide of movable jaw means 16. In addition, when locking means 34 is locked in position, restraint on pins 68 is exerted at the recesses 28 in the vertical faces 26, which is at a most massive part of bed 12. Further, the location of recesses 28 in vertical faces 26 substantially assists in reducing accumulation of swarf in recesses 28.

Various other changes and modifications may be made without departing from the spirit of the invention, such as, for example, the fixed jaw comprising a movable jaw means as described above, or otherwise slidably mounted on the bed for travel therealong to work-clamping position.

Various changes and modifications may be made in the ends 69 of pins 68 and in the recesses 28 to enable pins 68 to cam-out of recesses 28 as described above. For example, the ends 69 may be equipped with rollers so that the ends of pins 68 can roll out of recesses 28 rather than slide, or the ends 69 V-shaped and the recesses 28 appropriately V-shaped to receive such ends.

I claim:

1. A quick-release vice or work holder comprising:

a bed;

a fixed jaw affixed to said bed; and a movable jaw means;

said bed having a longitudinally extending T-shaped slot, said slot having opposing hidden substantially vertical faces each of said faces having a plurality of recesses therein, said movable jaw means having guide means and locking means, said guide means slidably mounted on said bed for travel therealong, said locking means including engaging means carried internally by said locking means and adapted to move transversely of said slot from a first position where said engaging means does not engage said recesses and said movable jaw means can be moved along said slot, to a second position where said engaging means can engage said recesses to lock said locking means with respect to said lock, said locking means comprising:

two pins; and actuator means adapted to move from an unlocking position to a locking position which causes said pins to engage two of said recesses in said opposing hidden substantially vertical faces; and wherein said recesses are of part-curved shape such that when said actuator means is in said unlocking position, said pins will cam-out of said two of said recesses if a moderate force is exerted on said locking means in a direction along the bed of said vice.

2. A vice or work holder as claimed in claim 1, wherein said locking means further comprises:

a pivoted bolt lever engaging a recess in said actuator means;

a substantially horizontal pivot rod affixed to said bolt lever and adapted to rotate about a horizontal axis; and a release lever affixed to said pivot rod such that movement of said release lever causes said actuator means to move between said unlocking position and said locking position.

3. A vice or work holder as claimed in claim 1 or 2, wherein said vertical faces have a plurality of opposing pairs of said recesses and said two of said recesses are an opposing pair.

4. A vice or work holder as claimed in claim 1 or 2 in which said movable jaw means further comprises means adapted to sweep swarf out of said recesses when said locking means is moved in a direction along the bed of said vice.

5. A quick-release vice or work holder comprising:

a bed;

a fixed jaw affixed to said bed; and a movable jaw means;

said bed having a longitudinally extending slot, said slot having opposing hidden substantially vertical faces each of said faces having a plurality of recesses therein, said movable jaw means having guide means and locking means, said guide means slidably mounted on said bed for travel therealong, said locking means including engaging means carried internally by said locking means and adapted to move transversely of said slot from a first position where said engaging means does not engage said recesses and said movable jaw means can be moved along said slot, to a second position where said engaging means can engage said recesses to lock said locking means with respect to said slot, said locking means comprising a pair of engaging means movable from within said movable jaw means toward a pair of said recesses to engage said pair of recesses and actuator means adapted to move from an unlocking position to a locking position, said actuator means adapted to pass longitudinally along said slot to pass between said pair of engaging means to cause said pair of engaging means to move to said second position.

6. The vice or work holder as claimed in claim 5 wherein said engaging means includes at least one pin and said recesses having a part-curved shape such that when said engaging means is in said first position, said pin will cam-out of said one of said recesses if a moderate force is exerted on said locking means in a direction along the bed of said vice.

7. A vice or work holder as claimed in claim 5 in which said engaging means includes two pins and wherein said recesses are of part-curved shape such that when said actuator means is in said unlocking position, said pins will cam-out of said one of said recesses if a moderate force is exerted on said locking means in a direction along the bed of said vice.

* * * * *